US008138130B2

(12) United States Patent
Nelson et al.

(10) Patent No.: US 8,138,130 B2
(45) Date of Patent: Mar. 20, 2012

(54) FUSED-RING AROMATIC AMINE BASED WEAR AND OXIDATION INHIBITORS FOR LUBRICANTS

(75) Inventors: Kenneth Dale Nelson, Napa, CA (US); Edward A. Chiverton, San Francisco, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 866 days.

(21) Appl. No.: 11/096,679

(22) Filed: Mar. 31, 2005

(65) Prior Publication Data

US 2006/0223717 A1 Oct. 5, 2006

(51) Int. Cl.

| | |
|---|---|
| ***C10M 135/36*** | (2006.01) |
| ***C10M 139/00*** | (2006.01) |
| ***C10M 169/04*** | (2006.01) |
| ***C10M 159/18*** | (2006.01) |
| ***C10M 133/58*** | (2006.01) |

(52) U.S. Cl. ..... 508/232; 508/189; 508/287; 508/230; 508/371; 508/293

(58) Field of Classification Search ..... 508/232, 508/287, 293, 185, 192, 189, 230, 371
See application file for complete search history.

(56) References Cited

U.S. PATENT DOCUMENTS

| | | | | |
|---|---|---|---|---|
| 3,194,812 | A | 7/1965 | Norman et al. | |
| 3,357,920 | A * | 12/1967 | Nacson | 508/294 |
| 3,367,864 | A | 2/1968 | Elliott et al. | |
| 3,714,045 | A | 1/1973 | Frangatos | |
| 4,370,246 | A | 1/1983 | deVries et al. | |
| 4,652,387 | A | 3/1987 | Andress, Jr. et al. | |
| 4,803,004 | A | 2/1989 | Andress et al. | |
| 4,863,623 | A | 9/1989 | Nalesnik | |
| 4,895,579 | A | 1/1990 | Andress et al. | |
| 5,026,493 | A * | 6/1991 | Lam et al. | 508/355 |
| 5,112,507 | A | 5/1992 | Harrison | |
| 5,137,980 | A | 8/1992 | DeGonia et al. | |
| 5,366,519 | A | 11/1994 | Cherpeck | |
| 5,393,309 | A | 2/1995 | Cherpeck | |
| 5,445,755 | A * | 8/1995 | Convents et al. | 510/305 |
| 5,490,945 | A | 2/1996 | Smith et al. | |
| 5,565,528 | A | 10/1996 | Harrison et al. | |
| 5,620,486 | A | 4/1997 | Cherpeck | |
| 5,625,004 | A | 4/1997 | Harrison et al. | |
| 5,716,912 | A | 2/1998 | Harrison et al. | |
| 5,756,434 | A | 5/1998 | Patil et al. | |
| 5,777,025 | A | 7/1998 | Spencer et al. | |
| 5,851,965 | A | 12/1998 | Harrison et al. | |
| 5,880,070 | A | 3/1999 | Harrison et al. | |
| 5,955,404 | A | 9/1999 | Horodysky et al. | |
| 6,107,450 | A | 8/2000 | Harrison et al. | |
| 6,207,624 | B1 | 3/2001 | Stachew et al. | |
| 6,451,920 | B1 * | 9/2002 | Harrison et al. | 525/327.4 |
| 6,548,458 | B2 | 4/2003 | Loper | |
| 6,715,473 | B2 | 4/2004 | Ritchie et al. | |
| 6,750,183 | B2 | 6/2004 | Gutierrez et al. | |
| 2004/0034175 | A1 * | 2/2004 | Kolp | 525/331.9 |
| 2004/0266955 | A1 * | 12/2004 | Nelson | 525/384 |
| 2005/0178049 | A1 | 8/2005 | Thiel et al. | |
| 2006/0025316 | A1 | 2/2006 | Covitch et al. | |

FOREIGN PATENT DOCUMENTS

| | | | |
|---|---|---|---|
| EP | 0 432 941 | A2 | 6/1991 |
| EP | 0 446 510 | | 9/1991 |
| EP | 0 355 895 | B1 | 12/1994 |
| EP | 0 721 010 | | 7/1996 |
| EP | 1 564 261 | A1 | 8/2005 |
| GB | 1 055 429 | | 1/1967 |
| WO | WO 2006/015130 | A1 | 2/2006 |

OTHER PUBLICATIONS

U.S. Appl. No. 60/592,566, Covitch et al.
International Search Report issued in counterpart European Patent Application No. 06251307.

* cited by examiner

*Primary Examiner* — Walter D Griffin
*Assistant Examiner* — Vishal Vasisth

(57) ABSTRACT

A multifunctional product is prepared by the reaction of an alkyl or alkenyl succinic acid derivative with a Fused-Ring Aromatic diamine, with a charge mole ratio of the diamine moiety in stoichiometric excess, under reactive conditions to thereby yield a multifunctional lubricant additive.

20 Claims, No Drawings

FUSED-RING AROMATIC AMINE BASED WEAR AND OXIDATION INHIBITORS FOR LUBRICANTS

FIELD OF THE INVENTION

This invention is related to a multifunctional additive which can serve as an oxidation inhibitor and/or an anti-wear agent and/or a soot dispersing agent when used in a lubricating oil composition.

BACKGROUND OF THE INVENTION

Reaction products of amines and various carboxylic acylating agents are known. These derivatives are useful as lubricating oil additives, particularly as dispersing agents. Common dispersing agents typically do not provide an anti-wear or anti-oxidant benefit and thus, usually are not referred to as multifunctional additives.

In recent years, the need for reduced emissions from motor vehicles has resulted in the use of new catalyst technology. This new technology is sensitive to additive elements present in conventional lubricants, such as sulfur and phosphorus. These elements are typically present due to the use of conventional wear and oxidation inhibitors. The metal surfaces of machinery or engines operating under heavy loads wherein metal slides against metal may undergo excessive wear or corrosion. Often the lubricants used to protect the metal surfaces deteriorate under such heavy loads and as a result, do not prevent wear at the points of metal to metal contact. Consequently, the performance of the machine or engine will suffer, and in aggravated cases the machine or engine may become completely inoperative.

Therefore, a need exists for low or non sulfur or phosphorus containing anti-wear and anti-oxidants. A particular need is for the preparation and identification of multifunctional additives, such as additives that combine wear, oxidation, and dispersancy.

U.S. Pat. No. 3,714,045 discloses a lubricating composition containing lubricants and a polyimide produced by reacting stoichiometric amounts of (1) a heteropolymer produced by reacting an olefin with maleic anhydride in the presence of a free radical initiator with (2) a primary arylamine.

U.S. Pat. No. 4,522,736 discloses a reaction product formed by reacting an alkenyl succinic acid or anhydride with first a diaromatic amine and then an alkanol amine. Likewise, U.S. Pat. No. 4,895,549 discloses a reaction product prepared by reacting an alkenyl succinic compound with an arylamine and a hindered alcohol.

U.S. Pat. No. 5,112,507 discloses a copolymer of an unsaturated acidic reactant and a high molecular weight alkylvinylidene olefin having a sufficient number of carbon atoms such that the resulting copolymer is soluble in lubricating oil and wherein the olefin has at least about one branch per two carbon atoms along the chain.

U.S. Pat. No. 4,234,435 discloses the use of carboxylic acid acylating agents which are derived from polyalkenes such as polybutenes and a dibasic carboxylic reactant such as maleic or fumaric acid. The acylating agents are further characterized by the presence, within their structure, of at least 1.3 groups derived from a dibasic carboxylic reactant for each equivalent weight of the polyalkene. The acylating agents are then further reacted with polyamines or polyols to produce derivatives that are useful as lubricant additives or as intermediates to be subjected to post treatment with various other chemical compounds.

U.S. Pat. No. 5,454,962 discloses a dispersing agent made by reacting aminoguanidine with a hydrocarbyl-substituted succinic acid or anhydride in a mole ratio of from about 0.4 to about 1.2 moles of the aminoguanidine per mole of the succinic acid compound.

SUMMARY OF THE INVENTION

The present invention is directed, in part, to a multifunctional additive which can be employed in lubricating oils and serve as a dispersing agent, an anti-oxidant agent and a (sulfur and phosphorous free) wear inhibiting agent. The multifunctional product is prepared by the reaction of an alkyl or alkenyl succinic acid derivative with a fused-ring aromatic diamine, with a charge mole ratio of the diamine moiety greater than stoichiometric, under reactive conditions to thereby yield a multifunctional lubricant additive.

More specifically, a composition is prepared by reacting a mixture under reactive conditions wherein the mixture comprises (a) an alkyl or alkenylsuccinic acid derivative, wherein the alkyl or alkenyl substituent has an average molecular weight of from 450 to 5,000; and (b) a diamino naphthyl compound of the formula I Formula I

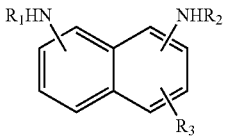

wherein $R_1$ and $R_2$ are independently selected from the group consisting of hydrogen and $C_{1-10}$ alkyl; and $R_3$ is hydrogen, hydroxyl, $C_{1-6}$ alky or $C_{1-6}$ alkoxy; and wherein the molar ratio of (a) to (b) is from about 1:1.5 to about 1:3.

The multifunctional product produced above, can be added to an oil of lubricating viscosity in an effective amount, for its intended service. These lubricating compositions typically contain from about 0.01 to 10 wt % and more preferably from about 0.5 to 5 wt % of the multifunctional product, based upon the total weight of the composition. In another aspect, this invention is directed towards lubricating concentrate formulations and formulated lubricating oil compositions containing the multifunctional product as well as other additives such as dispersants, detergents, anti-wear agents, antioxidants, etc.

Among other factors, the present invention is based upon the discovery that certain compounds produced by reacting a alkyl or alkenyl succinic acid derivative with a substantial excess of a diamino naphthyl compound under reactive conditions leads to a multifunctional product that is useful to provide anti-wear, antioxidancy and dipersancy to lubricating formulations.

DETAILED DESCRIPTION OF THE INVENTION

Definitions

As used herein the following terms have the following meanings, unless expressly stated to the contrary.

The term $M_n$ refers to the number average molecular weight of a polymer.

The term "1-olefin" refers to a monosubstituted olefin that has the double bond in the 1-position. They can also be called alpha-olefins, and have the following structure: $CH_2{=}CHR_q$ where $R_q$ is the rest of the olefin molecule.

The term "Total Base Number" or "TBN" refers to the amount of base equivalent to milligrams of KOH in 1 gram of sample. Thus, higher TBN numbers reflect more alkaline products and therefore a greater alkalinity reserve. The TBN of a sample can be determined by ASTM Test No. D2896 or any other equivalent procedure.

The term "SAP" refers to Saponification Number, which is reported in milligrams of KOH per gram of sample, and is a measure of the amount of acid groups in a gram of sample. SAP can be determined by the procedure described in ASTM D94 or any other equivalent procedure.

The term "TAN" refers to Total Acid Number, which refers to the amount of acid equivalent to milligrams of KOH in I gram of sample. TAN can be determined by the procedure described in ASTM D 664 or any other equivalent procedure.

The "succinic ratio" or "succination ratio" refers to the ratio calculated in accordance with the procedure and mathematical equation set forth in columns 5 and 6 of U.S. Pat. No. 5,334,321, hereby incorporated by reference. The calculation is asserted to represent the average number of succinic groups in an alkenyl or alkylsuccinic anhydride per alkenyl or alkyl chain.

Synthesis

The multifunctional compounds of the present invention can be prepared by contacting (a) an alkenyl or alkylsuccinic acid derivative with a substantial stoichiometric excess of (b) a diamino naphthyl compound of formula I, under reactive conditions. Typically, the multifunctional compounds produced are mixtures of products, which if desired could separated into the individual products by known separation techniques.

Typically, the above process is conducted by contacting an alkenyl or alkyl succinic acid derivative with from about 1.5 to about 3.0 molar equivalents of the diamino naphthyl compound. Preferred molar ratios are about one mole alkenyl or alkyl succinic acid derivative to about 1.7 to 2.5 mole diamino naphthyl compound, with ratios of about 1:2 being particularly preferred. In conducting this reaction, we have generally found it convenient to first add or prepare the alkenyl or alkylsuccinic acid derivative and optionally any unsaturated acidic reagent copolymer together and then add the diaminonaphthyl moeity. It may be desirable to conduct the reaction in an inert organic solvent or diluent. Optimum solvents will vary with the particular copolymer and can be determined from literature sources or routine experimentations, for example, neutral oil and mixtures of $C_9$ to $C_{11}$ aromatic solvents are acceptable solvents.

Typically, the reaction is conducted at temperatures in the range of about from 60° C. to 180° C., preferably 110° C. to about 150° C. for about from 1 to 10 hours, preferably 4 to 6 hours. Typically, the reaction is conducted at about atmospheric pressure; however, higher or lower pressures can also be used depending on the reaction temperature desired and the boiling point of the reactants or solvent.

Water, which is present in the system or generated by this reaction, is preferably removed from the reaction system during the course of the reaction via azeotroping or distillation. After reaction completion, the system can be stripped at elevated temperatures (typically 100° C. to 250° C.) and reduced pressures to remove any volatile components which may be present in the product.

The Alkenyl or Alkylsuccinic Acid Derivatives

Alkenyl-substituted succinic anhydrides have been used as dispersants. Such alkenyl substituted succinic anhydrides have been prepared by two different processes, a thermal process, referred to herein as "ene chemistry" (see, e.g., U.S. Pat. No. 3,361,673) and a chlorination process (see, e.g., U.S. Pat. No. 3,172,892). The polyisobutenyl succinic anhydride ("PIBSA") produced by the thermal process has been characterized to contain a double bond in the product. The chlorination process PIBSA's have been characterized as monomers containing either a double bond, a ring, other than a succinic anhydride ring and/or chlorine in the product. See J. Weill and B. Sillion, "Reaction of Chlorinated Polyisobutene with Maleic Anhydride:Mechanism Catalysis by Dichloromaleic Anhydride", Revue de l'Institut Francais du Petrole, Vol. 40, No. 1, pp. 7789 (January-February, 1985). Such compositions include one-to-one monomeric adducts (see, e.g., U.S. Pat. Nos. 3,219,666; 3,381,022) as well as adducts having polyalkenyl derived substituents adducted with at least 1.3 succinic groups per polyalkenyl derived substituent (see, e.g., U.S. Pat. No. 4,234,435 to Meinhardt). PIBSA serves as a ubiquitous precursor to several commercial crankcase ashless dispersants, including succinimides, succinates, succinate esters, and triazoles. In the formation of succinimides, the PIBSA is reacted with a polyamine to form a structurally complex mixture which can contain imide, amide, imidazoline and diamide groups.

In the preparation of an alkenyl succinic acid derivative, a polyalkene is reacted with an unsaturated acidic reagent which is a monounsaturated $C_4$ to $C_{10}$ dicarboxcylic acid and/or anhydride and/or ester, (preferable wherein (a) the carboxyl groups are vicinyl i.e. located on adjacent carbon atoms and (b) at least on and preferably both of the adjacent carbon atom are part of the mono unsaturation. Exemplary monounsaturated carboxylic reactants are fumaric acid, itaconic acid, maleic acid, maleic anhydride, lower alkyl (e.g. $C_1$ to $C_6$ alkyl) acid esters of the foregoing; e.g. methyl maleate, ethyl fumarate, etc., electron-deficient olefins such as monophenyl maleic anhydride; monomethyl, dimethyl, monochloro, monobromo, monofluoro, dichloro and difluoro maleic anhydride, N-phenyl maleimide and other substituted maleimides; isomaleimides; fumaric acid, maleic acid, alkyl hydrogen maleates and fumarates, dialkyl fumarates and maleates, fumaronilic acids and maleanic acids; and maleonitrile, and fumaronitrile Particularly preferred unsaturated acidic reagents refers to maleic or fumaric reactants of the general formula:

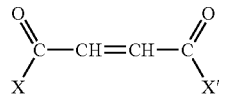

wherein X and X' are the same or different, provided that at least one of X and X' is a group that is capable of reacting to esterify alcohols, form amides, or amine salts with ammonia or amines, form metal salts with reactive metals or basically reacting metal compounds and otherwise function as acylating agents. Typically, X and/or X' is —OH, —O-hydrocarbyl, $-OM^+$ where $M^+$ represents one equivalent of a metal, ammonium or amine cation, $—NH_2$, —Cl, —Br, and taken together X and X' can be —O— so as to form an anhydride. Preferably, X and X' are such that both carboxylic functions can enter into acylation reactions i.e. both carboxyl functions of the succinic group (i.e. both—C(O)X and —C(O)X') can enter into acylation reactions. Maleic anhydride is a particularly preferred unsaturated acidic reactant.

The unsaturated acid reagent is reacted with a polyalkene under suitable conditions so that the monounsaturation of the monounsaturated carboxyclic reactant becomes saturated. The polyalkenyl moiety can be a polymer of a single type olefin or it can be a copolymer of two or more types of olefins. Preferably, the polyalkene is polybutene, and more preferably a polyisobutene. The polyalkene has a number average molecular weight of from about 450 to about 5,000, preferably about 450 to about 2,500, more preferably between 500 to about 2,300 and even more preferably from about 550 to about 1,300. As used herein, the molecular weight of a dispersant is generally expressed in terms of the molecular weight of the polyalkenyl moiety as the precise molecular weight range of the dispersant of the present invention depends on numerous parameters including the type of polymer used to derive the dispersant, the number of functional groups, and the type of nucleophilic group employed. Preferably, the mole ratio of unsaturated acidic reagent to polyalkene is preferably at least 1:1. More preferably, that mole ratio is from 1:1 to 4:1. Preferably, the feed time of the unsaturated acidic reagent is from 0.4 to 1.2 hours. Preferably, the reaction time of forming the polyalkenyl derivative is from 2 to 6 hours.

Suitable polyolefin polymers for reaction with maleic anhydride and other succinic acid derivatives include polymers comprising a major amount of $C_2$ to $C_5$ monoolefin, e.g., ethylene, propylene, butylene, iso-butylene and pentene. The polymers can be homopolymers, such as polyisobutylene, as well as copolymers of two or more such olefins, such as copolymers of: ethylene and propylene, butylene, and isobutylene, etc. Other copolymers include those in which a minor amount of the copolymer monomers (e.g., 1 to 20 mole percent), is a $C_4$ to $C_8$ nonconjugated diolefin, e.g., a copolymer of isobutylene and butadiene or a terpolymer of ethylene, propylene and 1,4-hexadiene, etc.

A particularly preferred class of olefin polymers for reaction with maleic anhydride comprises the polybutenes, which are prepared by polymerization of one or more of 1-butene, 2-butene and isobutene. Especially desirable are polybutenes containing a substantial proportion of units derived from isobutene. The polybutene may contain minor amounts of butadiene, which may or may not be incorporated in the polymer. These polybutenes are readily available commercial materials well known to those skilled in the art. Examples of procedures illustrating the preparation of such material can be found, for example, in U.S. Pat. Nos. 3,215,707; 3,231,587; 3,515,669; 3,579,450; 3,912,764 and 4,605,808, hereby incorporated by reference for their disclosures of suitable polybutenes.

Other suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR_a$ wherein $R_a$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R_a$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1,4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers of this invention may contain a minor amount, e.g. 0.5 to 5 mole % of a $C_4$ to $C_{18}$ non-conjugated diolefin comonomer. However, it is preferred that the polymers of this invention comprise only alpha-olefin homopolymers, interpolymers of alpha-olefin comonomers and interpolymers of ethylene and alpha-olefin comonomers. The molar ethylene content of the polymers employed in this invention is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930. Also useful are the copolymers prepared from mixtures of ethylene and alpha olefin using a metallocene/alumoane catalyst such as described in EP 440 507 A2 and U.S. Pat. No. 5,652,202.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75% by wt., and an isobutene content of about 30 to about 60% by wt., in the presence of a Lewis acid catalyst, such as aluminum trichloride or boron trifluoride as disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream to prepare reactive isobutylene polymers with terminal vinylidene olefins. Preferably, these polymers, referred to as highly reactive polyisobutylene (HR-PIB), have a terminal vinylidene content or methylvinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Particularly preferred is the use a polyalkene that initially contains greater than about 50% of the methylvinylidene isomer, and wherein the polyalkene is treated with strong acid prior to the thermal reaction with the unsaturated acidic reagent so that less than 50% of the polyalkene has methylvinylidene end groups. The term strong acid used herein, refers to an acid having a $pK_a$ of less than about 4. Preferably, the strong acid is an oil-soluble, strong organic acid, but even nonorganic strong acids would work (e.g., HCl, $H_2SO_4$, $HNO_3$, HF, etc.). More preferably, the strong acid is a sulfonic acid. Still more preferably, the sulfonic acid is an alkyl aryl sulfonic acid. Most preferably, the alkyl group of said alkyl aryl sulfonic acid has from 4 to 30 carbon atoms. Typically, the sulfonic acid is present in an amount in the range of from 0.0025% to 1% based on the total weight of polyalkene The thermal reaction of a polyolefin with maleic anhydride is well known and is described, for example, in U.S. Pat. No. 3,361,673. Less desirable is the chlorination process characterized by the reaction of a chlorinated polyolefin, with maleic anhydride, which is also well known and is described, for example, in U.S. Pat. No. 3,172,189. Various modifications of the thermal process and chlorination process are also well known, some of which are described in U.S. Pat. Nos. 4,388,471; 4,450,281; 3,018,250 and 3,024,195. Free radical procedures for preparing alkenyl succinic anhydrides are, for example, described in U.S. Pat. Nos. 5,286,799 and 5,319,030. Also desirable are alkenyl succinic anhydrides prepared by the reaction of high methylvinylidene polyisobutene with unsaturated succinic acid derivatives as described in U.S. Pat. Nos. 4,152,499 and 5,241,003, and European Application EP 0 355 895. All of the above referenced patents are hereby incorporated herein by reference in their entirety.

The alkenyl or alkyl succinic acid derivative may also be prepared using the so-called highly reactive or high methyl vinylidene polyalkylene, most commonly polyisobutene, such as described in U.S. Pat. Nos. 4,152,499; 5,071,919; 5,137,980; 5,286,823; 5,254,649; published International Applications Numbers WO 93 24539-A1; WO 9310063-A1; and published European Patent Applications Numbers 0355895-A; 0565285A; and 0587381A, all of which are hereby incorporated by reference in their entirety. Other polyalkenes can also be used including, for example, polyalkenes prepared using metallocene catalysts such as described in published German patent application DE 4313088A1.

Alkyl and alkenyl succinic acid derivatives having a calculated succinic ratio of about from 1.0:1 to 2.5:1, and preferably about from 1.0:1 to 1.5:1, may be used in the present process. More preferably, the alkyl or alkenyl succinic acid derivatives have a succination ratio of about from 1.0:1 to 1.2:1. Most preferably, alkyl or alkenylsuccinic anhydrides are used. Accordingly, in one aspect, it is preferred to use an alkenyl succinic anhydride prepared by the thermal process, both because the calculated succination ratio of material prepared by this process is typically 1.0 to 1.2, and because the product is essentially chlorine-free because chlorine is not used in the synthesis.

A particularly preferred method for preparing the alkenyl or alkyl succinic acid derivatives is to thermally reacting a polyalkene with an unsaturated acidic reagent at elevated temperatures in the presence of strong acid. To achieve high conversion, the reaction is preferably conducted by contacting the polyalkene, the unsaturated acidic reagent and the strong acid at reaction temperatures. Typically, the reaction is conducted at temperatures in the range of about from 140° to 280° C., preferably 150° to 170° C. for about from 1 to 10 hours, preferably 4 to 6 hours. Typically the reaction is conducted at about atmospheric pressure; however, higher or lower pressures can also be used depending on the reaction temperature desired and the boiling point of the reactants or solvent. Alternatively the pressure can be super-atmospheric and in this aspect preferably the reaction is conducted in the range from 180° to 240° C. The presence of the strong acid results in an increase in the % conversion of the polyalkene. The presence of the strong acid also results in low insoluble resin, low soluble resin, and low succinic ratio. However, this is also dependent on the other reaction conditions such as MA feed time, the mole ratio of unsaturated acidic reagent to polyalkene (CMR), the reaction time, and the reaction temperature.

The strong acid results in isomerization of the end group double bond of the polyalkene. This is especially true in the absence of the unsaturated acidic reagent. For example, if the end group composition of the polyalkene consists mostly of the methylvinylidene isomer, the strong acid treatment of the polyalkene results in isomerization of the methylvinylidene isomer to a trisubstituted isomer, a tetrasubstituted isomer, and other isomers whose structures have not yet been determined. This isomerization is dependent on the reaction time, the temperature, and the concentration of the strong acid. If the strong acid is added to a mixture of the polyalkene and the unsaturated acidic reagent, then an isomerization of the polyalkene and an increase in the % conversion of the polyalkene is obtained. In addition, other side reactions, such as dimerization of the polyalkene, isomerization of the double bond of the polyalkylene derivative, etc. may take place. In conducting this reaction, it is often convenient to first add the polyalkene and the strong acid, let the polyalkene and strong acid react to reduce the amount of methylvinylidene end groups in the polyalkene, then react it with the unsaturated acidic reagent. This is convenient because generally the polyalkene is usually heated to remove traces of water before addition of the unsaturated acidic reagent. The strong acid can be added at this time resulting in no increase in the batch cycle time. Preferably, pretreatment of polyalkene is conduction with a strong acid prior to the addition of the unsaturated acidic reagent is sufficient to produce a polyalkylene having less than 50% (more preferably less than 40%) methylvinylidene end groups.

In another aspect, the strong acid, polyalkene and unsaturated acidic reagent are added together at the beginning of the reaction. Then the temperature is increased so that isomerization of the methylvinylidene end group of the polyalkene occurs but reaction with the unsaturated acidic reagent does not take place. Then after the methylvinylidene content reaches the desired level, the temperature is increased sufficiently so that the reaction of the polybutene with the unsaturated acidic reagent to form polyalkylene derivative takes place. Alternatively, the polyalkene, the strong acid, and the unsaturated acidic reagent are all added together, or the polyalkene and the unsaturated acidic reagent can be added first, followed by the addition of the strong acid. Other possible orders of addition are possible (such as polyalkene and part of the strong acid, then the unsaturated acidic reagent, then the rest of the strong acid). All possible orders of addition are considered to be within the scope of this invention.

As known in the art, polyalkenyl succinic anhydrides may be converted to polyalkyl succinic anhydrides by using conventional reducing conditions such as catalytic hydrogenation. For catalytic hydrogenation, a preferred catalyst is palladium on carbon.

The Diamino Naphthyl Reactant

Not withstanding the manner in which the alkyl or alkenylsuccinic acid derivatives were prepared, the alkyl or alkenylsuccinic acid derivatives are further derivatized with a nitrogen-containing nucleophilic reactant, such as a diamino naphthyl reactant.

The diamino naphthyl reactant of the present invention are depicted by formula I

I

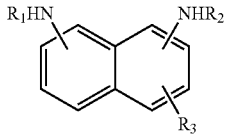

wherein $R_1$ and $R_2$ are independently selected from the group consisting of hydrogen and alkyl from $C_{1-10}$; and $R_3$ is hydrogen, hydroxyl, $C_{1-6}$ alky or $C_{1-6}$ alkoxy. Particularly preferred is where at least one of $R_1$ or $R_2$ is hydrogen and even more preferably where both $R_1$ and $R_2$ are hydrogen. Preferably $R_3$ is hydrogen or alkyl and even more preferably $R_3$ is hydrogen. Preferred amine substitution on the diamino naphthyl moiety are at the 1,5; 1,6; 1,7; 1,8; 2,6 and 2,7; with the 1,5 and 1,8 positions being particularly preferred. Particularly preferred $R_3$ is hydrogen; however, when $R_3$ is other than hydrogen the preferred point of substitution on the diamino naphthyl moiety is at the 3 or 4 position with the 3 position being particularly preferred.

The diamino naphthyl reactant may be a single compound but typically will be a mixture of compounds reflecting commercial products or synthesis compounds. Typically there will be a mixture in which one or several compounds predominate with the average composition indicated. For example, 1,8-naphthylenediamine commonly is commercially produced by metal-acid reduction or by catalytic hydrogenation of 1,8-dinitronapthalene, Ger. Offen. 2,523,351 (Dec. 9, 1976).

Methods of preparation of amines and their reactions are detailed in Sidgewick's THE ORGANIC CHEMISTRY OF NITROGEN, Clarendon Press, Oxford, 1966; Noller's CHEMISTRY OF ORGANIC COMPOUNDS, Saunders, Philadelphia, 2nd Ed., 1957; and Kirk-Othmer's ENCYCLOPEDIA OF CHEMICAL TECHNOLOGY, 2nd Ed., especially Volume 2, pp. 99-116, and for naphthalene derivatives, Volume 15, pp. 698-749.

Post-Treatments

The properties of the present multifunctional compounds of the present invention may be generally further improved by reaction with an acidic reagent selected from a boron containing compound and/or a molybdenum containing compound. This post treating reaction may be conducted neat, wherein both the multi functional compound and the acidic reagent are combined in the proper ratio. Depending on the viscosity it may be desirable to conduct the reaction using an inert organic solvent or diluent, for example, toluene, xylene. Examples of particularly suitable acidic reagents include, for example, boric acid and molybdic acid.

For example, the multifunctional compounds of the present invention can be treated with a boron compound selected from the class consisting of boron oxide, boron halides, boron acids and esters of boron acids in an amount to provide from about 0.1 atomic proportion of boron for each mole of nitrogen in said multifunctional compound to about 20 atomic proportions of boron for each atomic proportion of nitrogen of said multifunctional compound. These borated multifunctional compounds of the invention contain from about 0.05 to 2.0 wt. %, e.g. 0.05 to 0.7 wt. % boron based on the total weight of said borated nitrogen-containing multifunctional compound. The boron, which appears to be in the product as dehydrated boric acid polymers (primarily $(HBO_2)_3$), is believed to attach to the multifunctional compound as amine salts, e.g., the metaborate salt.

Treating is readily carried out by adding from about 0.05 to 4, e.g. 1 to 3 wt. % (based on the weight of said nitrogen compound) of said boron compound, preferably boric acid which is most usually added as a slurry to said nitrogen compound and heating with stirring at from about 135° C. to 190° C.; e.g. 140-170° C., for from 1 to 5 hours followed by nitrogen stripping at said temperature ranges.

The molybdenum compounds used to prepare the molybdenum complexes used in the compositions of this invention are acidic molybdenum compounds or salts of acidic molybdenum compounds. By acidic is meant that the molybdenum compounds will react with a basic nitrogen atom of, the multifunctional product, in which the basicity of the basic nitrogen compound can be determined by ASTM test D664 or the D2896 titration procedure. Typically, these acidic molybdenum compounds are hexavalent and are represented by the following compositions: molybdic oxide, molybdic acid, ammonium molybdate, sodium molybdate, potassium molybdates and other alkaline metal molybdates and other molybdenum salts such as hydrogen salts, e.g., hydrogen sodium molybdate, $MoOCl_4$, $MoO_2Br_2$, $Mo_2O_3Cl_6$, molybdenum trioxide or similar acidic molybdenum compounds. Preferred acidic molybdenum compounds are molybdic oxide, molybdic acid, ammonium molybdate, and alkali metal molybdates. Particularly preferred is molybdenum trioxide.

The post treatment may be conduction with or without a promoter and with or without a diluent. The diluent is used, if necessary, to provide a suitable viscosity for easy stirring, or for the azeotropic distillation of water. Typical diluents are lubricating oil and liquid compounds containing only carbon and hydrogen. If desired, ammonium hydroxide may also be added to the reaction mixture to provide a solution of ammonium molybdate. In this reaction, a basic nitrogen-containing compound, i.e. the multifunctional compound, neutral oil, and water are charged to the reactor. The reactor is agitated and heated at a temperature less than or equal to about 120° C., preferably from about 70° C. to about 90° C. Molybdic oxide is then charged to the reactor and the temperature is maintained at a temperature less than or equal to about 120° C., preferably at about 70° C. to about 90° C., until the molybdenum is sufficiently reacted. The reaction time for this step is typically in the range of from about 2 to about 30 hours and preferably from about 2 to about 10 hours. Typically excess water is removed from the reaction mixture. Removal methods include but are not limited to vacuum distillation or nitrogen stripping. Preferably during stripping the temperature of the reactor in maintained at a temperature less than or equal to about 120° C. Stripping is ordinarily carried out under reduced pressure. The pressure may be reduced incrementally to avoid problems with foaming. After the desired pressure is reached, the stripping step is typically carried out for a period of about 0.5 to about 5 hours and preferably from about 0.5 to about 2 hours.

Lubricating Oil Compositions and Concentrates

The lubricating oil compositions of the present invention can be conveniently prepared by simply blending or mixing a multifunctional product prepared by the reaction of a) an alkyl or alkenyl succinic acid derivative wherein the alkyl or alkenyl substituent has an average molecular weight of form 450 to 5000 with b) a diamino naphthyl compound of the formula I, defined herein above; wherein the molar ratio of a) to b) is from about 1:1.5 to about 1:3, with an oil of lubricating viscosity (base oil). The lubricating oil composition may also be directed to a post treated multifunctional product. The multifunctional compositions of this invention may also be pre-blended as a concentrated or package with various other additives in the appropriate ratios to facilitate blending a finished lubricating composition containing the desired concentration of additives. In one aspect, the multifunction compositions of this invention are blended with a oil of lubricating viscosity at a concentration at which these compositions provide and oxidation benefit; in another aspect, these multifunctional compositions are added at a concentration at which these compositions provide wear protection.

The lubricating oil, or base oil, used in the lubricating oil compositions of the present invention are generally tailored to the specific use e.g. engine oil, gear oil, industrial oil, cutting oil, etc. For example, where desired as an engine oil, the base oil typically will be a mineral oil or synthetic oil of viscosity suitable for use in the crankcase of an internal combustion engine such as gasoline engines and diesel engines which include marine engines. Crankcase lubricating oils ordinarily have a viscosity of about 1300 cSt at 0° F. to 24 cSt at 210° F. (99° C.) the lubricating oils may be derived from synthetic or natural sources.

Mineral oil for use as the base oil in this invention includes paraffinic, naphthenic and other oils that are ordinarily used in lubricating oil compositions. Synthetic oils include both hydrocarbon synthetic oils and synthetic esters. Hydrocarbon synthetic oil may include, for example, oils prepared from the polymerization of ethylene or form the polymerization of 1-olefins, such as polyolefins or PAO, or from hydrocarbon synthesis procedures using carbon monoxide and hydrogen gases, such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used. Blends of various mineral oils, synthetic oils and minerals and synthetic oils may also be advantageous, for example to provide a given viscosity or viscosity range. In general the base oils or base oil mixtures for engine oil are preselected so that the final lubricating oil, containing the various additives, including the present wear protectant, has a viscosity at 100° C. of 4 to 22 centistokes, preferably 10 to 17 centistokes and more preferably 13 to 17 centistokes.

Typically the lubricating oil composition will contain a variety of compatible additives desired to impart various properties to the finished lubricating oil composition depending on the particular end use and base oils used. Such additives include neutral and basic detergents such as natural and overbased organic sulfonates and normal and overbased phenates and salicylates, dispersants, ashless dispersants such as various polyalkylsuccinimides or polyalkylsuccinic acid esters, rust inhibitors, foam inhibitors, pour point dispersants, antioxidants, including the so called viscosity index (VI) improvers, dispersant VI improvers and, as noted above, other corrosion or wear inhibitors including oxidation inhibitors such as phenol compounds and amine compounds; defoaming agents such as dimethylpolysiloxane and polyacrylate; friction modifiers such as higher fatty acids, higher alcohols, aliphatic amines, fatty acid amides, esters of fatty acids, sulfurized fats, acidic phosphate esters, acidic phosphite esters, organic molybdenum compounds, and solid lubricants; corrosion inhibitors such as benzotriazole and thiazole; viscosity index improvers (which may be active type having increased dispersability) such as acrylic polymer, methacrylic polymer and olefin copolymer; and pour point depressants such as acrylic polymer, methacrylic polymer, polybutene, polyalkylstyrene and polyvinylacetate. Some of these additives are further described below.

Suitable detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt. % (preferably at least 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety. Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol. Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Suitable dispersants are for example Mannich base condensation products and mono and polysuccinimides are well known in the art. Generally, Mannich products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Succinimide compounds are also know and are formed by reacting an alkenyl succinic acid derivative with an amine moiety, typically a polyamine. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof. The succinimide can be post treated such as with ethylene carbonate or boron. A preferred EC-treated dispersant is a polybutene succinimide derived from polybutenes having a molecular weight of at least 1800, preferably from 2000 to 2400. The EC-treated succinimide of this invention is described in U.S. Pat. Nos. 5,334,321 and 5,356,552.

Suitable oil soluble phosphorous containing agents include esters prepared from phosphorous acid and aliphatic or aromatic alcohols (dilauryl phosphate, diphenyl phosphate, dioleyl phosphate, mono & dibutyl phosphate) and esters prepared from phosphoric acid and aliphatic or aromatic alcohols (monooctyl phosphate, dioctyl phosphate, trioctyl phosphate, etc.). Dimethyl esters of aliphatic phosphonic acids in which the aliphatic group has an average in the range of about 12 to about 24 carbon atoms are fully described in U.S. Pat. No. 4,158,633. The aliphatic group can be saturated or unsaturated, and branched or straight chain in structure. Preferred are the dimethyl esters of aliphatic phosphonic acids wherein the aliphatic group has an average in the range of about 16 to about 20 carbon atoms. Most preferred are the phosphonate esters wherein the aliphatic group is relatively pure and contains about 18 carbon atoms or a mixture of phosphonate esters in which the aliphatic groups contain an average of about 18 carbon atoms, such as mixture derived from commercial technical grades of oleyl chloride.

Typical metal-free phosphorus-containing anti-wear and/or extreme pressure additives used in the practice of this invention include esters of phosphorus acids, amine salts of phosphorus acids and phosphorus acid-esters. Examples of suitable compounds which may be used as phosphorus-containing anti-wear and/or extreme pressure agents include trihydrocarbyl phosphites, phosphonates and phosphates, and dihydrocarbyl phosphites; such as tricresyl phosphate, cresyl diphenyl phosphate, tributyl phosphate, trioleyl phosphate, trilauryl phosphate, tributyl phosphite, trioctyl phosphite, triphenyl phosphite, tricresyl phosphite, tricyclohexyl phosphite, dibutyl lauryl phosphonate, dibutyl hydrogen phosphite, dioleyl hydrogen phosphite, and tolyl phosphinic acid dipropyl ester. Among the amine salts which can be employed are amine salts of partially esterified phosphoric, phosphorous, phosphonic, and phosphinic acids; amine salts of phosphonic acids and the like. Specific examples include the dihexylammonium salt of dodecylphosphoric acid, the diethyl hexyl ammonium salt of dioctyl dithiophosphoric acid, the octadecylammonium salt of dibutyl phosphoric acid, the dilaurylammonium salt of 2-ethylhexylphosphoric acid, the dioleyl ammonium salt of butane phosphonic acid, and analogous compounds.

The ester, amide or amine salt portion of the dithiophosphate will generally have from 1 to 20 carbons, preferably 4 to 10 carbons, and from 0 to 5 nitrogens (when the amide or amine salt is employed, that portion preferably has from 1 to 3 nitrogens with the carbon to nitrogen atomic ratio preferably ranging from 1 to 10). The ester, amide or amide salt portion of the dihydrocarbyl dithiophosphate anti-wear agent will contain stable organic moieties such as hydrocarbon or ethoxylated hydrocarbon groups.

Exemplary dihydrocarbyl dithiophosphate amides include the ethyl amide of di-4-methyl-2-pentyl dithiophosphate, the butyl amide of diisoctyl dithiophosphate, the aminoethyl amide of ditetrapropenylphenyl dithiophosphate, the diamino diethylene amide of ditetrapropenylphenyl dithiophosphate, and diamino diethylene amide of di-2-ethyl-1-hexyl dithiophosphate.

Metal containing phosphorus compounds are formed by reacting a dihydrocarbyl dithiophosphoric acid with a metal oxide, for example zinc oxide, The hydrocarbyl portion of the dithiophosphoric acid will usually have from 4 to 20 carbons, preferably from 5 to 12 carbons, and more preferably from 6 to 8 carbons. As referred to herein, the term "hydrocarbyl" represents a monovalent organic radical composed essentially of hydrogen and carbon, but minor amounts of inert substituents may be present. The hydrocarbyl may be aliphatic, aromatic or alicyclic or combinations thereof, for example, aralkyl, alkyl, aryl, cycloalkyl, alkylcycloalkyl, etc., and may be saturated or olefinically unsaturated. Exemplary hydrocarbyl groups include methyl, ethyl, propyl, butyl, pentyl, 4-methylpentyl, 2-ethylhexyl, hexyl, octyl, isooctyl, stearyl, phenyl, benzyl, ethylbenzyl, propenylphenyl, dipropenylphenyl, tetrapropenylphenyl, tolyl, etc. The primary, secondary or tertiary hydrocarbyl groups may be employed, but the branched-chain, primary groups are preferred, even more preferred are mixtures of aliphatic groups and in a preferred embodiment, at least 75 mole percent of sec-butyl alcohol is used and preferably combined with 4-methyl-2-pentanol, and most preferably further combined with a zinc metal. Particularly preferred metal dihydrocarbyl phosphorodithioates include the zinc dithiophosphates. Patents describing the synthesis of such zinc dithio-phosphates include U.S. Pat. Nos. 2,680,123; 3,000,822; 3,151,075; 3,385,791; 4,377,527; 4,495,075 and 4,778,906. Each of these patents is incorporated herein by reference in their entirety. Exemplary zinc dihydrocarbyl dithiophosphates include zinc di-n-octyl dithiophosphate, zinc butyl isooctyl dithiophosphate, zinc di-4-methyl-2-pentyl dithiophosphate, zinc ditetrapropenylphenyl dithiophosphate, zinc di-2-ethyl-1-hexyl dithiophosphate, zinc diisoctyl dithiophosphate, zinc dihexyl dithiophosphate, zinc diphenyl dithiophosphate, zinc diethylphenyl dithiophosphate, zinc diamyl dithiophosphate, zinc butyl phenyl dithiophosphate, zinc dioctadecyl dithiophosphate.

Alkali-metal borates or hydrates thereof are well known in the art as extreme pressure additives and are available commercially. Examples of the alkali-metal borates or hydrates thereof include potassium borate hydrate and sodium borate hydrate represented by $KB_3O_5.H_2O$ and $NaB_3O_5.H_2O$, respectively. These alkali-metal borate hydrates are, for example, prepared by the steps of dissolving potassium (or sodium) hydroxide and boric acid in water so that the atomic ratio of boron to alkali-metal (potassium or sodium) would be in the range of 2.0 to 4.5 (boron/alkali-metal), dispersing the solution in an oily solution containing a neutral alkaline earth metal sulfonate or an ashless dispersant of succinimide type, and allowing it to react to obtain the desired hydrate in the form of a dispersion liquid of fine particles. The gear lubricating oil composition of the invention comprises the alkali-metal borate or hydrate thereof in an amount of 0.04 to 1.0 wt. % in terms of boron content, preferably 0.05 to 0.6 wt. %, more preferably 0.08 to 0.5 wt %. This amount corresponds to about 0.6 to 15 wt. % of alkali-metal borate or hydrate thereof in the lubricating oil composition, if OLOA 9750 (dispersion liquid of potassium borate hydrate, commercially available from Chevron Oronite Company LLC, Houston Tex., boron content: 6.8 wt. %) is employed as the alkali-metal borate.

One type of copper corrosion inhibitors which can be used in the practice of this invention is comprised of thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the 2,5-bis(hydrocarbyldithio) -1,3,4-thiadiazoles, a number of which are commercially available. Other suitable inhibitors of copper corrosion include ether amines; polyethoxylated compounds such as ethoxylated amines, ethoxylated phenols, and ethoxylated alcohols; imidazolines; and the like.

Suitable antifoam agents for use in the compositions of this invention include silicones and organic polymers such as acrylate polymers. Mixtures of silicone-type antifoam agents such as the liquid dialkyl silicone polymers with various other substances are also effective. Typical of such mixtures are silicones mixed with an acrylate polymer, silicones mixed with one or more amines, and silicones mixed with one or more amine carboxylates. Other such mixtures include combinations of a dimethyl silicone oil with (i) a partial fatty acid ester of a polyhydric alcohol (U.S. Pat. No. 3,235,498); (ii) an alkoxylated partial fatty acid ester of a polyhydric alcohol (U.S. Pat. No. 3,235,499); (iii) a polyalkoxylated aliphatic amine (U.S. Pat. No. 3,235,501); and (iv) an alkoxylated aliphatic acid (U.S. Pat. No. 3,235,502).

The formulations may also contain a rust inhibitor. This may be a single compound or a mixture of compounds having the property of inhibiting corrosion of ferrous metal surfaces. Such materials include oil-soluble monocarboxylic acids such as 2-ethylhexanoic acid, lauric acid, myristic acid, palmitic acid, oleic acid, linoleic acid, linolenic acid, behenic acid, cerotic acid, etc., and oil-soluble polycarboxylic acids including dimer and trimer acids, such as are produced from tall oil fatty acids, oleic acid, linoleic acid, or the like. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid, and the like; long-chain alpha-omega-dicarboxylic acids in the molecular weight range of 600 to 3000; and other similar materials.

When lubricating compositions contain on or more of the above mentioned additives, each additive is typically blended into the base oil in an amount which enables the additive to provide its desired function. Representative effective amounts listed as mass percent active ingredients when used as an engine oil and preferably a crankcase lubricant are illustrated herein: multifunctional product of the invention from 0.01 to 10 and preferably 0.5 to 5; ashless dispersant from 0.1 to 20 and preferably 1-8; detergent from 0.1 to 15 and preferably 0.2 to 9; metal dialkyl dithiophosphate from 0.01 to 6 and preferably 0.05 to 5 based upon phosphorous content; antioxidant from 0 to 5 and preferably 0.01 to 1.5; pour point depressant from 0.01 to 5 and preferably 0.01 to 1.5; antifoaming agent from 0 to 5 and preferably 0.001 to 0.15; supplemental anti-wear agents from 0 to 0.5 preferably 0 to 0.2; friction modifier form 0 to 3 and preferably 0 to 1; viscosity modifier from 0 to 6 and preferably 0.01 to 4; with the above being in weight percent based upon the total weight of the composition. Additionally, these additives may be added to a gear oil formulation in the ranges depicted above. However, preferably a gear lubricating composition comprises: a major amount of oil of lubricating viscosity; 0.01 to 10 wt. % preferably 0.5 to 8.0 wt. % of the multifunctional product, 1 to 5 wt % of a sulfurized olefin; 0.05 to 5.0 wt. % in terms of phosphorous content of at least one oil soluble phosphorous containing compound selected from extreme pressure agents and anti-wear agents; 0.04 to 1.0 wt. % in terms of boron content of an alkali-metal borate or hydrate thereof. Additionally such gear lubricating further comprises at least one of the following additional components: 0.1 to 5 wt. % based upon the weight of said lubrication composition of at least one ashless dispersant; 0.1 to 0.8 wt. % based upon the weight of said lubrication composition of at least one copper corrosion inhibitor; 0.01 to 0.1 wt. % based upon the weight of said lubrication composition of at least one foam inhibitor; and, 0.01 to 0.1 wt. % % based upon the weight of said lubrication composition of at least one antirust agent.

Additive concentrates are also included within the scope of this invention. The concentrates of this invention usually include from 90 to 10 weight percent of an organic liquid diluent and from 10 to 90 weight percent of the multifunction product of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (380° C.), although an oil of lubricating viscosity may be used. The present concentrate will typically contain about 20 to 60 wt. % of the multifunctional product or post-treated product.

Preparations and Examples

A further understanding of the invention can be had in the following nonlimiting Preparations and Examples. Wherein unless expressly stated to the contrary, all temperatures and temperature ranges refer to the Centigrade system and the term "ambient" or "room temperature" refers to about 20° C.-25° C. The term "percent" or "%" refers to weight percent and the term "mole" or "moles" refers to gram moles. The term "equivalent" refers to a quantity of reagent equal in moles, to the moles of the preceding or succeeding reactant recited in that example in terms of finite moles or finite weight or volume.

EXAMPLES

Example 1

Preparation of a 1,8-DAN Derivative (550 PIBSA; 2:1 CMR)

In a 50-mL reactor was combined 7.33 g/0.0117 mol 550-MW polyisobutyl succinic anhydride (SAP# 178.8 mgKOH/g) with 6.02 g toluene. A magnetic stir bar was used to stir the mixture as it was heated under nitrogen to 95° C. When mixture had reached 95° C., 3.65 g/0.0231 mol 1,8-diaminonaphthalene was added to the reactor. Mixture was heated to 116° C. and the toluene was allowed to reflux for approx. 2.5 hours. After 2.5 hours temperature was increased to 121° C. and nitrogen was bubbled through the product to remove the toluene. The final mass of product was 10.93 g.

Example 2

Preparation of a 1,8-DAN Derivative (1000 PIBSA; 2:1 CMR)

In a 50-mL reactor was combined 6.23 g/0.00431 mol 1000-MW polyisobutyl succinic anhydride (SAP# 77.9 mgKOH/g) with 6.01 g toluene. A magnetic stir bar was used to stir the mixture as it was heated under nitrogen to 95° C. When mixture had reached 95° C., 1.35 g/0.0085 mol 1,8-diaminonaphthalene was added to the reactor. Mixture was heated to 116° C. and the toluene was allowed to reflux for approx. 2.5 hours. After 2.5 hours temperature was increased to 121° C. and nitrogen was bubbled through the product to remove the toluene. The final mass of product was 7.76 g.

Example 3

Preparation of a 1,5-DAN Derivative (550 PIBSA; 2:1 CMR)

This product was prepared in the same manner as Example 1. Thus, 8.92 g (0.00852 mol) of 1000MW PEBSA, 3.10 g (0.0170 mol) of 1,5-diaminonaphthalene were reacted to prepare a dark red product that was soluble in lubricating oil.

Example 4

Preparation of a Mo Post-Treated 1,8-DAN Derivative (1000PIBSA; 2:1 CMR))

In a 150-mL beaker was prepared a slurry of 3.3 g molybdenum oxide in 36.4 g deionized water. This solution was heated and stirred to uniformity. In a 50-mL reactor was combined 5.6 g/0.0022 mol of a product made in the same manner as example 2 with 4.7 g toluene. This mixture was stirred by a magnetic stir bar and heated to 50° C. When the mixture reached 50° C., 2.12 g/0.0022 mol of the molybdenum oxide slurry was added to the reactor. The reactor was then heated to 85° C. for 45 minutes then the temperature was increased to 101.3° C. and allowed to reflux for 1.2 hours. After 1.2 hours, nitrogen was bubbled through the product to drive off the solvent. After approximately half of the solvent was removed sparging was halted and the reactor was heated to 130° C. in a nitrogen environment. After 45 minutes, sparging was reinitiated until all of the solvent was removed. Final mass of product was 5.75 g.

Example 5

Preparation of a Mo Post-Treated 1,8-DAN Derivative (550 PIBSA; 2:1 CMR)

In a 150-mL beaker was prepared a slurry of 3.3 g molybdenum oxide in 36.4 g deionized water. This solution was heated and stirred to uniformity. In a 50-mL reactor was combined 5.0 g/0.0035 mol of a product made in the same manner as example 1 with 5.5 g toluene. This mixture was stirred by a magnetic stir bar and heated to 50° C. When the mixture reached 50° C., 3.41 g/0.0035 mol of the molybdenum oxide slurry was added to the reactor. The reactor was then heated to 85° C. for 45 minutes then the temperature was increased to 101.3° C. and allowed to reflux for 1.2 hours. After 1.2 hours, nitrogen was bubbled through the product to drive off the solvent. After approximately half of the solvent was removed sparging was halted and the reactor was heated to 130° C. in a nitrogen environment. After 45 minutes, sparging was reinitiated until all of the solvent was removed. Final mass of product was 5.45 g.

Example 6

Preparation of a Boric Acid Post-Treated 1.8-DAN Derivative (1000PIBSA; 2:1 CMR)

In a 150-mL beaker was prepared a solution of 1.95 g boric acid in 29.24 g deionized water. This solution was heated and stirred to uniformity. In a 50-mL reactor was combined 7.3 g/0.0028 mol of a product made in the same manner as example 2 with 4.2 g toluene. This mixture was stirred by a magnetic stir bar and heated to 50° C. When the mixture reached 50° C., 4.62 g/0.0027 mol of the boric acid solution was added to the reactor. The reactor was then heated to 85° C. for 45 minutes then the temperature was increased to 101.3° C. and allowed to reflux for 1.2 hours. After 1.2 hours, nitrogen was bubbled through the product to drive off the solvent. After approximately half of the solvent was removed sparging was halted and the reactor was heated to 130° C. in a nitrogen environment. After 45 minutes, sparging was reinitiated until all of the solvent was removed. Final mass of product was 5.56 g.

Example 7

Preparation of a Boric Acid Post-Treated 1,8-DAN Derivative (550 PIBSA; 2:1)

In a 150-mL beaker was prepared a solution of 1.95 g boric acid in 29.24 g deionized water. This solution was heated and stirred to uniformity. In a 50-mL reactor was combined 5.7 g/0.0040 mol of a product made in the same manner as example 1 with 4.6 g toluene. This mixture was stirred by a magnetic stir bar and heated to 50° C. When the mixture reached 50° C., 9.07 g/0.0052 mol of the boric acid solution was added to the reactor. The reactor was then heated to 85°

C. for 45 minutes then the temperature was increased to 101.3° C. and allowed to reflux for 1.2 hours. After 1.2 hours, nitrogen was bubbled through the product to drive off the solvent. After approximately half of the solvent was removed sparging was halted and the reactor was heated to 130° C. in a nitrogen environment. After 45 minutes, sparging was reinitiated until all of the solvent was removed. Final mass of product was 8.87 g.

Examples 8-11 and Comparative Examples A and B

Preparation of 1,8-diaminonaphthyl Derivatives

Six products were prepared using a PRS50 six station parallel reactor manufactured by J-Kem scientific. To each of six 50 ml reactor tubes was added about 20 g of reagent grade toluene and a PIBSA having a polyisobutylene tail of 550 or 1000 $M_n$, and 1,8 Diaminonaphthalene of 99% purity from Aldrich Chemical Company. The reactors were stirred under nitrogen and heated to reflux for about 5 hours. Nitrogen was then bubbled through each reactor and the temperature was increased to 130° C. such that toluene and water were removed. After the products were cooled to room temperature, reactor tubes 2-6 contained darkly colored oils, and reactor 1 contained a mixture of darkly colored oil and crystalline solids. Reactor 1 correlates to Example 8, the remaining particulars of the reaction conditions are outlined in Table 1.

TABLE 1

Mass and CMR of 1,8-DAN Derivatives

| Example No. | PIBSA, mw | PIBSA, g | PIBSA, mol | 1,8-DAN, g | CMR 1,8-DAN:PIBSA |
|---|---|---|---|---|---|
| Example 8 | 550 | 5.7 | 0.0091 | 4.29 | 3:1 |
| Example 9 | 550 | 9.0 | 0.014 | 4.55 | 2:1 |
| Example 10 | 1000 | 10.2 | 0.0071 | 3.33 | 3:1 |
| Example 11 | 1000 | 11.9 | 0.0083 | 2.63 | 2:1 |
| Comparative Example A | 550 | 13.1 | 0.021 | 3.31 | 1:1 |
| Comparative Example B | 1000 | 11.6 | 0.0081 | 1.27 | 1:1 |

Comparative Example C

Preparation of 1,8-DAN Derivative with 550 PIBSA and 1:1 CMR

In a 50-mL reactor was combined 5.89 g/0.0093 mol 550-MW polyisobutyl succinic anhydride (SAP# 178.8 mgKOH/g) with 7.96 g toluene. A magnetic stir bar was used to stir the mixture as it was heated under nitrogen to 95° C. When mixture had reached 95° C., 1.35 g/0.0085 mol 1,8-diaminonaphthalene was added to the reactor. Mixture was heated to 120° C., cooling water was initiated, and the toluene was allowed to reflux for approx. 2.5 hours. After 2.5 hours cooling water was disengaged and nitrogen was bubbled through the product to remove the toluene.

Performance Examples

The baseline formulations employed formulated oils. The formulated oil comprised lubricating oil and additives in their typical amounts for particular purpose; these included Baseline 1: a Group II base oil of a viscosity grade of 5W20 that contained: 0.5 wt. % of an LOB synthetic sulfonate, 4 wt % of a 2300 molecular weight ethylene carbonate post-treated bis-succinimide dispersant, 1.14 wt. % of an HOB synthetic sulfonate, 0.43 wt. % of a secondary alcohol ZnDTP, and viscosity index improvers. Baseline 2: a Group II base oil of a viscosity grade of 5W20 that contained: 3 wt. % of a 2300 molecular weight ethylene carbonate post-treated bissuccinimide dispersant, 1 wt. % of an LOB sulfonate, 2.4 wt. % of an HOB phenate, 0.6 wt % of a secondary alcohol ZnDTP, 0.5 wt. % of an amine antioxidant, and a viscosity index improver. Baseline 3: a mixture of 5% salicylate detergent and 7% viscosity index improver in an 85/15% blend of 150 and 600 neutral group I base oils. Baseline 4: a Group II base oil of a viscosity grade of 5W20 that contained: 3 wt. % of a 2300 molecular weight ethylene carbonate post-treated bis-succinimide dispersant, 1.4 wt. % of a borated succinimide dispersant, 2.3 wt. % of an HOB phenate, 0.6 wt. % of a secondary alcohol ZnDTP, 1 wt. % of an amine antioxidant, and a viscosity index improver. Baseline 5: 10W-40 group III base oil that contained: 3 wt. % borated succinimide dispersant, 5 wt. % of a 2300 molecular weight ethylene carbonate post-treated bissuccinimide dispersant, 0.5 wt. % of an LOB sulfonate, 5 wt. % of a salicylate detergent, 0.6 wt. % of a secondary alcohol ZnDTP, 0.4 wt. % of a molybdenum anti-oxidant, 0.5 wt. % of an amine anti-oxidant, and viscosity index improvers.

Examples 14-19

Oxidation Inhibitor Performance—Antioxidant properties

Oxidation studies were carried out in a bulk lube oil oxidation bench test as described by E. S. Yamaguchi et al. in *Tribology Transactions*, Vol. 42 (4), 895-901 (1999). In this test the rate of oxygen uptake by a given volume of oil, with added metal catalyst, is monitored at constant pressure and temperature, 171° C. and 2 psig $O_2$. For the test results reported in Table 2, the time until a marked increase in the rate of oxygen uptake was observed, is reported. The products of Examples 8-11 and Comp. Example 1 and Comp. Example 2 were top-treated to baseline 1 such that the treat-rate of the 1,8-DAN derivative was 1 wt %.

TABLE 2

Oxidation Test Results

| Performance Example | Preparation Example | Oxidation Inhibition Time (Hrs) |
|---|---|---|
| Baseline 1 | N/A | 8.4 |
| Example 12 | Ex. 8 (PIBSA 550; CMR 3:1) | 10.4 |
| Example 13 | Ex. 9 (PIBSA 550; CMR 2:1) | 12.4 |
| Example 14 | Ex. 10 (PIBSA 1000; CMR 3:1) | 9.7 |
| Example 15 | Ex. 11 (PIBSA 1000; CMR 2:1) | 9.2 |
| Comparative 1 | Comparative. Ex. A (PIBSA 550; CMR 1:1) | 8.7 |
| Comparative 2 | Comparative. Ex. A (PIBSA 1000; CMR 1:1) | 9.0 |

These results show that the multifunctional compounds of the invention (Ex 12-15) are effective for mediation of oxidation, showing improvement over the baseline 1. The lower molecular weight compounds show directional improvement in ability to inhibit oxidation. Especially notable is the unexpected improvement in oxidation inhibition time for Example 13. Comparative 1 and 2 show little improvement in comparison to baseline.

Examples 16-19

Four-Ball Wear Test

The Four-Ball Wear Test were performed according to ASTM D-4172. The products of Examples 1, 2, 6, 7 and Comparative Example C were top-treated to baseline 2 such that the treat-rate of the 1,8 DAN derivative was about 1 wt. %. Table 3 below, shows the wear test results.

TABLE 3

Four Ball Wear Test Results

| Performance Example | Preparation Example | Wear Scar, mm |
|---|---|---|
| Baseline 2 | N/A | 0.485 |
| Comparative 3 | Comparative Ex. C (PIBSA 550; CMR 1:1) | 0.469 |
| Example 16 | Ex. 1 (PIBSA 550; CMR 2:1) | 0.391 |
| Example 17 | Ex. 7 (PIBSA 550; CMR 2:1; B) | 0.368 |
| Example 18 | Ex. 2 (PIBSA 1000; CMR 2:1) | 0.469 |
| Example 19 | Ex. 6 (PIBSA 1000; CMR 2:1; B) | 0.662 |

The four ball wear scar test results indicate the anti-wear properties of the compounds of the present invention. In this test, lower wear scars are indicative of improved anti-wear performance. Particularly notable is Examples 16-17 which illustrate a dramatic improvement over the baseline. These results show that in the 4-ball wear test, the multifunctional compounds made from the 550 molecular weight polybutene tails having a 2:1 CMR gave better performance compared to those made from a 1:1 CMR; or even the 1000 molecular weight polybutene tails with a 2:1 CMR.

Examples 20 and 21

Soot Dispersancy Test

The products of Examples 7 and 8 were top-treated to baseline 3 such that the treat-rate for example 24 was 2 wt. % and the treat-rate for example 25 was 1 wt. %.

Soot Dispersancy tests were carried out in the soot thickening bench test. This gives an indication of the performance of these multifunctional compounds. The details of this test are reported in U.S. Pat. No. 5,716,912. The % viscosity increase, as measured in the soot thickening bench test, is reported in Table 3.

TABLE 3

Soot Thickening Bench Test

| Performance Example | Preparation Example | % Viscosity Increase |
|---|---|---|
| Baseline 3 | N/A | 245 |
| Example 20 | Ex. 1 (PIBSA 550; CMR 2:1) | 205.6 |
| Example 21 | Ex. 2 (PIBSA 1000; CMR 2:1) | 210.5 |

In the soot thickening bench test, better results are obtained from those samples which gave lower % viscosity increase. These results show that in the soot thickening bench test, the multifunctional compounds made from the 550 molecular weight polybutene tails gave slightly better performance compared to those made from the 1000 molecular weight polybutene tails. However, it is notable that both Examples showed an improvement is comparison to the baseline.

Examples 26-28

Small Engine Wear Test

The products of examples 7, 8, and 10 were top-treated into baseline 4 such that the treat-rate was 1 wt %.

The anti-wear properties of baseline 4, and examples 26-28 were evaluated using a small engine wear test. The test oil is demonstrated in a small engine coupled to a fixed load such as a dynamometer or generator for a period of approximately sixty hours. The engine was an air-cooled single cylinder overhead valve engine manufactured by Briggs and Stratton which was modified to accelerate camshaft wear. The load on the valve train was increased by replacement of the factory valve springs with a set of dual springs. For each test, the engine was outfitted with a new factory camshaft, and tappets. The engine was used until a visual inspection of the crankshaft, cylinder liner, and carburetor indicated abnormal wear or imminent failure. Prior to any testing, each engine was run-in using conventional engine oil for 10 hours at a speed of 3,000 rpm and a specified load. The engine was prepared with the test oil and a run-in period of approximately one hour was conducted at the onset of each trial with modified engine operated under load for the remainder of the test. Camshaft wear was measured by comparison of the cam profiles before and after each test. The results are shown in Table 4.

TABLE 4

Engine Test Results

| Performance Example | Preparation Example | Can Wear (in) Intake | Can Wear (in) Exhaust |
|---|---|---|---|
| Baseline 4 | N/A | 0.01065 | 0.00284 |
| Example 22 | Ex. 1 (PIBSA 550; CMR 2:1) | 0.00453 | 0.00060 |
| Example 23 | Ex. 2 (PIBSA 1000; CMR 2:1) | 0.00231 | 0.00021 |
| Example 24 | Ex. 5 (PIBSA 550; CMR 2:1; Mo) | 0.00451 | 0.00075 |

These results demonstrate the wear inhibiting properties of the compounds of the invention in a small engine test.

Example 29

HFRR Wear Test

Baseline oil #5 was top-treated with the product of Example 3 (1,5-DAN derivative) such that the treat rate was about 1 wt %. To this top-treated oil was added diesel engine exhaust soot such that the oil contained about 6.0 wt % soot. The oil and soot were blended for 15 minutes on a high shear rotor stator type mixer, and then a wear test was conducted. The sooted oil was evaluated on a PCS instruments HFRR wear tester. Test specimens were a 6 mm 52100 steel ball on flat, oil temperature was 116° C., frequency was 20 hz, the load was 1 kg, and the test duration was 20 minutes. The wear scar on the ball was measured after the test using an optical microscope. The wear scar diameter for an average of three test runs was 194 μm. This was compared to the baseline oil in the same manner which demonstrated a wear scar diameter for an average of three test runs was 195 μm. Thus, there was a slight improvement is the HFRR test when top treating a small amount of the product of Example 3.

What is claimed is:

1. A composition prepared by reacting a mixture under reactive conditions wherein the mixture consists essentially of: (a) an alkyl or alkenylsuccinic acid derivative, wherein the alkyl or alkenyl substituent has an average molecular weight of from 450 to 5,000, and wherein the alkyl or alkenylsuccinic acid derivative is prepared by thermally reacting maleic anhydride with a polyalkylene in the presence of a strong acid; and (b) a diamino naphthyl compound of the formula

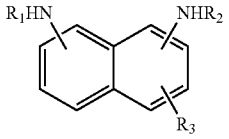

wherein $R_1$ and $R_2$ are independently selected from the group consisting of hydrogen and $C_{1-10}$ alkyl; and $R_3$ is hydrogen, hydroxyl, $C_{1-6}$ alkyl or $C_{1-6}$ alkoxy; and wherein the molar ratio of (a) to (b) is from about 1:1.5 to about 1:3.

2. The composition according to claim 1, wherein the alkyl or alkenyl substituent has an average molecular weight of from 450 to 2,500.

3. The composition according to claim 1, wherein the alkyl or alkenyl substituent has an average molecular weight of from 550 to 1,300.

4. The composition according to claim 1, wherein the polyalkylene initially contains greater than 50% of a methylvinylidene isomer, and the polyalkylene is treated with strong acid prior to the reaction with maleic anhydride so that less than 50% of the polyalkylene has methylvinylidene end groups.

5. The composition according to claim 1, wherein the polyalkylene is polyisobutylene.

6. The composition according to claim 1, wherein the alkenyl succinic acid derivative is prepared from the thermal reaction of maleic anhydride with polyisobutylene having a $M_n$ of from 450 to 3000.

7. The composition according to claim 1, wherein $R_1$ is hydrogen.

8. The composition according to claim 7, wherein $R_2$ is hydrogen.

9. The composition according to claim 8, wherein $R_3$ is hydrogen.

10. The composition according to claim 8 wherein the di amino naphthyl compound is selected from the group consisting of naphthalene-1,5-diamine; naphthalene-1,6-diamine; naphthalene-1,7-diamine; and naphthalene-1,8-diamine.

11. The composition according to claim 8 wherein the diamino naphthyl compound is selected from the group consisting of naphthalene-2,6-diamine; and naphthalene-2,7-diamine.

12. The composition according to claim 1, wherein $R_3$ is hydroxyl, $C_{1-6}$ alkyl or $C_{1-6}$ alkoxy.

13. The composition according to claim 1, wherein $R_3$ is hydrogen or $C_{1-6}$ alkyl.

14. The composition according to claim 1, wherein the molar ratio of (a) to (b) is from about 1:1.7 to about 1:2.5.

15. The composition according to claim 14, wherein the molar ratio of (a) to (b) is about 1:2.

16. The composition according to claim 1, wherein the composition is further reacted with an acidic reagent selected from a molybdenum compound or a boron compound.

17. A lubricating composition comprising: 1) an oil of lubricating viscosity; and 2) a multifunctional product prepared by the process of reacting a mixture under reactive conditions wherein the mixture consists essentially of: (a) an alkyl or alkenylsuccinic acid derivative, wherein the alkyl or alkenyl substituent has an average molecular weight of from 450 to 5,000, and wherein the alkyl or alkenylsuccinic acid derivative is prepared by thermally reacting maleic anhydride with a polyalkylene in the presence of a strong acid; and (b) a diamino naphthyl compound of the formula

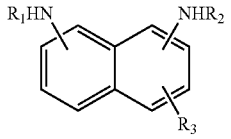

wherein $R_1$ and $R_2$ are independently selected from the group consisting of hydrogen and $C_{1-10}$ alkyl; and $R_3$ is hydrogen, hydroxyl, $C_{1-6}$ alkyl or $C_{1-6}$ alkoxy; and wherein the molar ratio of (a) to (b) is from about 1:1.5 to about 1:3.

18. The lubricating composition according to claim 17, wherein the composition contains from about 0.01 to 10 wt % of the multifunctional product, based upon the total weight of the composition.

19. The lubricating composition according to claims 18 wherein the composition contains from about 0.5 to 5 wt % of the multifunctional product, based upon the total weight of the composition.

20. The lubricating composition according to claim 19, further comprising: 3) an ashless dispersant; 4) a detergent; 5) a metal dialkyl dithiophosphate.

* * * * *